United States Patent [19]

Johnson

[11] Patent Number: 4,506,465

[45] Date of Patent: Mar. 26, 1985

[54] PIVOTABLE TOWED SNOW REMOVAL BLADE

[75] Inventor: Terry D. Johnson, Littleton, Colo.

[73] Assignee: Melvin L. Robinson, Cherokee, Iowa ; a part interest

[21] Appl. No.: 452,117

[22] Filed: Dec. 22, 1982

[51] Int. Cl.[3] ..... E01H 5/06

[52] U.S. Cl. ..... 37/268; 172/799.5

[58] Field of Search ..... 37/197, 103, 117.5, 37/268-271, 129, DIG. 3, 2 R, 14, DIG. 12, 130-133, 126 R, 124, 118 R; 172/196, 799.5

[56] References Cited

U.S. PATENT DOCUMENTS

| | | | |
|---|---|---|---|
| 2,059,818 | 11/1936 | Simon | 37/271 X |
| 2,292,904 | 8/1942 | Shollenberger | 37/2 R X |
| 2,311,639 | 2/1943 | Click | 37/133 |
| 2,552,426 | 5/1951 | Hedley | 37/271 X |
| 2,689,055 | 9/1954 | Kizer et al. | 56/474 |
| 2,695,490 | 11/1954 | Bohner | 56/474 |
| 2,840,933 | 7/1958 | Brem | 37/117.5 |
| 2,923,074 | 2/1960 | Tucker | 37/117.5 X |
| 3,044,196 | 7/1962 | Kinney | 37/266 X |
| 3,160,215 | 12/1964 | Harrell | 37/2 R X |
| 3,430,703 | 3/1969 | Richey | 37/117.5 |
| 3,547,203 | 12/1970 | Jackoboice | 37/117.5 |
| 3,800,447 | 4/1974 | Harvey | 37/268 X |
| 4,010,561 | 3/1977 | Klett | 37/DIG. 12 |
| 4,010,805 | 3/1977 | Kelley | 37/2 R X |

OTHER PUBLICATIONS

First Press Release: Snowdozer 620, Dec. 28, 1981.
Snowdozer Model 620, not earlier than Jan. 1982.

*Primary Examiner*—E. H. Eickholt
*Attorney, Agent, or Firm*—Merchant, Gould, Smith, Edell, Welter & Schmidt

[57] ABSTRACT

Apparatus and method for snow removal is disclosed. A wheeled frame having an adjustable suspension capable of operation in a snow removal and a transport position is provided. The frame is open at one end and includes a hitch at the other end for connection to a prime mover. Two vertical snow cutting knives are connected to the frame near the open end thereof with a horizontal snow cutting knife connecting the vertical knives proximate the ground. A snow moving blade is pivotably supported to the frame and actuated by a pair of double acting cylinders to move up and down. In operation the open end of the apparatus is pushed into a pile of snow and snow is cut loose by the knives. The blade is then lowered into close proximity with the ground and near the open end of the frame whereby a selected quantity or block of snow may be pulled or towed away.

3 Claims, 4 Drawing Figures

PIVOTABLE TOWED SNOW REMOVAL BLADE

BACKGROUND OF THE INVENTION

The present invention pertains to the field of material moving apparatus, and more particularly to the field of snow removal apparatus.

Currently, snow blowers, front end loaders and snowplows are most commonly employed for the removal or relocation of snow. In the case of snow blowers, snow is collected, pulverized and thrown to a new location. In the case of front end loaders, snow is relocated by pushing or lifting it with the bucket. In the case of snowplows, snow is removed by pushing or plowing utilizing a blade usually angled to force the snow to one side of the plow. With each of these apparatus, considerable energy is expended in not only moving the snow, but in either throwing, lifting or pushing the snow, especially when it is hard packed or drifted, as extra energy is used in pulverizing, breaking or compacting in the process.

Generally, the above noted apparatus are characterized by complexity, as in the case of the snow thrower or the plow blade suspension apparatus, or by heavy duty design, as in the case of front end loaders and snowplows. Naturally, it would be desirable to accomplish snow removal without the need for either complex or heavy duty equipment.

Quite differently from the above described apparatus, the present invention provides a relatively simple method and apparatus which may be employed to relocate or remove snow without compacting, pulverizing or lifting it, as will be hereinafter described.

SUMMARY OF THE INVENTION

The present invention provides a method and apparatus for snow removal. The method involves cutting a selected quantity of snow and sliding it to a new location. The apparatus is supported on a wheeled frame, which is substantially open at one end and includes a hitching means for coupling to a prime mover at the other end. Snow cutting means for cutting a quantity of snow loose from its position as the apparatus is moved over the ground are located on the frame near the open end. To move the cut snow, a blade is provided, mounted for movement between a first snow moving position of close proximity to the ground and a second snow cutting position in which the blade is raised substantially above the ground.

According to one aspect of the invention, the frame is rectangular and is adjustably suspended over the wheels so that the frame and snow cutting means may be raised substantially clear of the ground for transport. According to still another aspect of the invention, the snow cutting means includes a pair of vertically oriented knives, one connected to each side of the frame, and a horizontally oriented knife extending between the vertical knives proximate the ground. According to still another aspect of the invention, the blade is mounted to the frame with a pair of elongated beams connected for actuation with a pair of double acting hydraulic cylinders mounted between the frame and the beams. According to still another aspect of the invention, the apparatus further includes a pair of side plates mounted on opposite ends of the blade adjacent and perpendicular to the edges thereof for preventing snow from spilling around the blade.

DETAILED DESCRIPTION OF THE INVENTION

Figure 1:
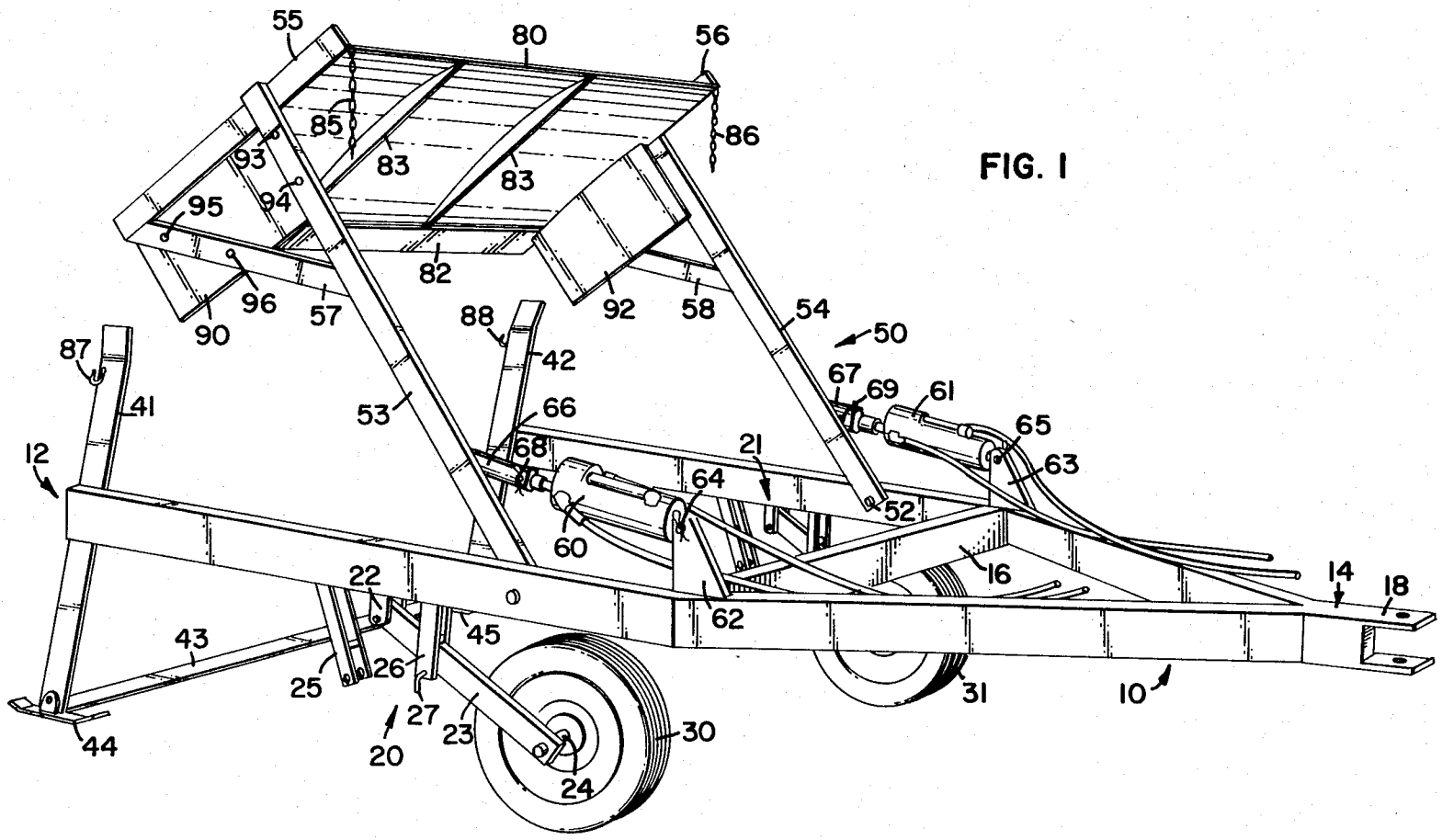
FIG. 1 is a perspective view of the snow removal apparatus according to the present invention.
Figure 2:
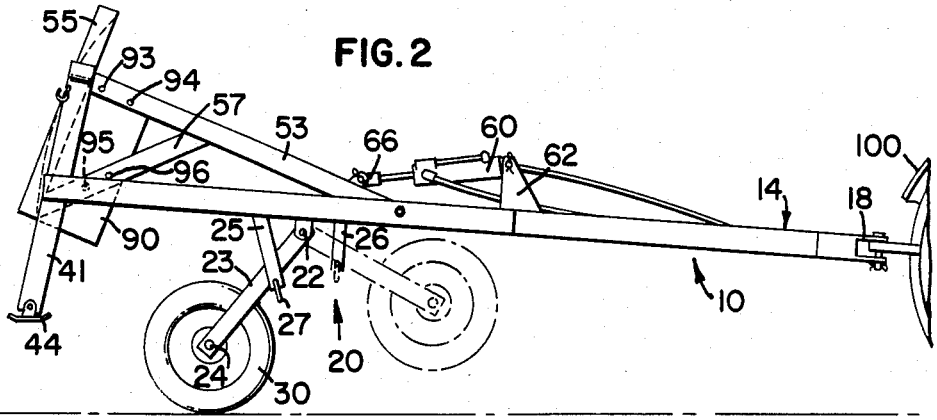
FIG. 2 is a side elevation of the snow removal apparatus of FIG. 1.
Figure 3:
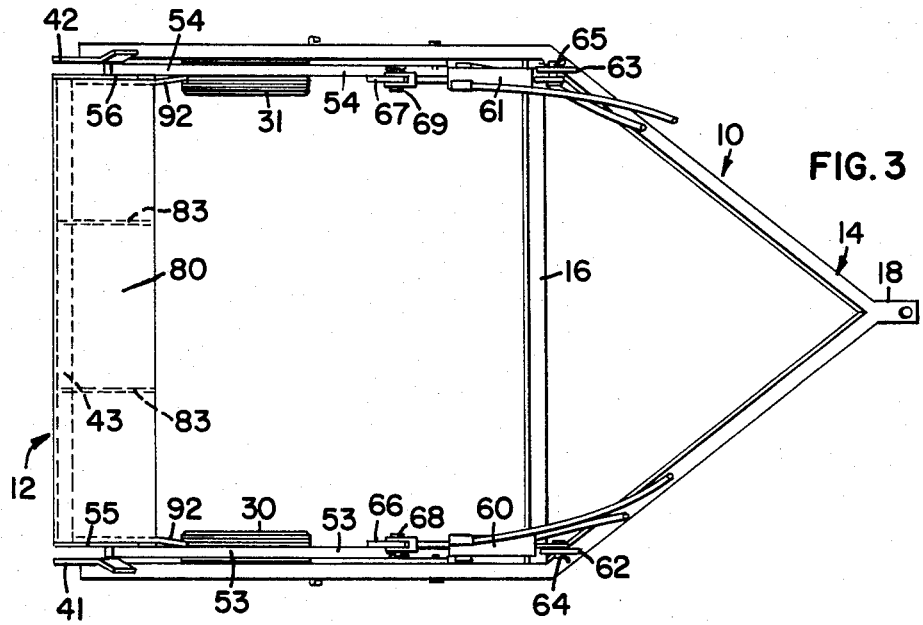
FIG. 3 is a top plan of the snow removal apparatus of FIGS. 1 and 2.

The following description is made with respect to FIGS. 1–4, in which the same parts bear the same reference numerals. A frame 10 having an open end 12 and a hitch end 14 is shown supported for movement over the ground by suspensions 20, 21 and wheels 30 and 31. The frame 10 includes a cross-member 16 between the generally rectangular open end 12 and the generally triangular hitch end 14. Although the hitch shown is of the pin and tongue variety, any other suitable coupling device such as a ball and tongue may be used. Suspension 20 includes a U-shaped bracket 22 mounted to the frame and an armature 23 hingably connected to bracket 22 at one end and connected to wheel 30 with an axle 24 at the other end. Suspension 20 further includes trailing link brackets 25 and 26 extending downwardly from the frame on either side of bracket 22 and having openings near the tips thereof for receiving a locking pin 27. In FIG. 1, armature 23 is shown locked to bracket 26, which is the position for snow removal operation. In FIG. 2, armature 23 may be seen locked in bracket 25, to suspend frame 10 for transport. Although not specifically described, it will be understood that suspension 21 is identical to suspension 20.

Three snow cutting knives 41, 42 and 43 are provided near the open end 12 of the frame 10. Knives 41 and 42 are connected to opposite sides of the frame and extend, when the frame is in the lowered position as illustrated in FIG. 1, from proximate the ground to a height of approximately four feet. Each of knives 41 and 42 is provided with a skid pad, 44 and 45 respectively, for preventing the knives from penetrating the ground. A cutting knife 43 is mounted horizontally between the vertical cutting knives 41 and 42 just above the skid pads 44 and 45. In the illustrated embodiment, the cutting knives are approximately four inch by one-half inch steel.

A blade 80 and subframe assembly 50 is pivotally mounted medial frame 10 at hinges 51 and 52. Subframe 50 includes a pair of elongated beams 53 and 54 mounted to the respective blade supporting members 55 and 56 and diagonal cross braces 57 and 58. Subframe assembly 50 further includes a pair of double acting cylinders 60 and 61 pivotably connected at one end to the respective mounting plates 62 and 63 at hinge pins 64 and 65, which are retained in place with cotter pins. At the other ends, cylinders 60 and 61 are connected to members 66 and 67, which are rigidly attached to the respective beams 53 and 54. Pivoting connection is provided for with pins 68 and 69, which are also provided with cotter pins. Although not described herein, it will be understood that double acting cylinders 60 and 61 are provided with the usual hydraulic fittings for connection to a hydraulic power source.

A blade 80 is disposed between supporting members 55 and 56. As seen more clearly in FIG. 4, blade 80 has an arcuate curvature, and includes a scraper blade 82 removably mounted along the bottom edge thereof. The blade further includes reinforcing members 83 and 84. (See FIG. 1.) Mounted near the top edge of the blade 80 are two chains 85 and 86 which, if desired, may be connected to the respective hooks 87 and 88 when the apparatus is in transport.

Optionally, a pair of vertical side plates 90 and 92 may be provided for mounting along each side of the blade. Preferably, side plates 90 and 92 are removably attached with bolts, for example, as shown with respect to plate 90 at 93–96.

Figure 4:
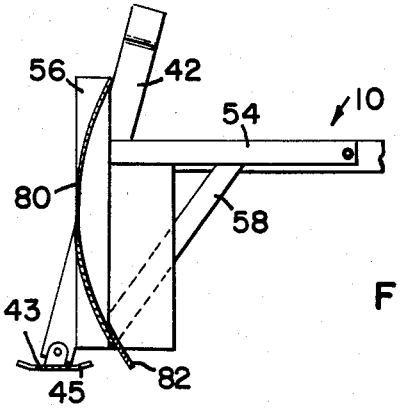
FIG. 4 is a partial cut-away side view of the snow removal apparatus of FIGS. 1, 2 and 3 taken along lines 4—4 in FIG. 3.

For snow removal operation, suspensions 20 and 21 are adjusted to the position illustrated in FIG. 1. When driven by a prime mover, for example a tractor 100 as shown in FIG. 2, the apparatus of the present invention may be utilized in several ways. In its usual mode of operation, blade 80 is raised through control of cylinders 60 and 61 to a position like that illustrated in FIG. 1, although the extent to which the blade 80 is raised depends upon the snow conditions. Next, with the skid pads 44 and 45 in contact with or proximate the ground, knives 41–43 on open end 12 are moved into a pile of snow so that the open rectangular area is substantially filled. Because the knives 41–43 cut through the snow quite easily, little energy is expended in this maneuver. A rectangularly shaped quantity of snow is thereby cut loose from the pile by knives 41–43. With the apparatus parked in this position, the blade 80 is lowered into the pile, again with cylinders 60 and 61, until, preferably, the blade comes to rest substantially as illustrated in FIG. 4. Removal of the snow contained within the boundaries of the rectangular portion of the frame 10 and the blade 80 is then easily accomplished by pulling or towing the snow to a new location where it may be released by raising the blade 80 and moving the apparatus forward. In this manner, snow may be removed or relocated without compacting, pulverizing or lifting as has been the common practice heretofore.

In summary, the preferred method of moving snow with the apparatus 10 comprises the steps of:

raising the snow moving blade 80 to a position substantially above the ground;

moving said apparatus 10 in a rearwardly direction so that the snow cutting knives 41, 42 and 43 pass into a pile of snow loosening a quantity of snow from the pile;

lowering the blade 80 into the pile of snow to a position proximate the knives 41–43;

moving the apparatus 10 in a forwardly direction, retaining the snow in front of the blade 80 positioning the apparatus 10 over a location for storage of the snow;

raising the blade 80 to the position substantially above the ground; and again moving the apparatus 10 in a forwardly direction away from the loosened snow.

If desired, the present invention may also be used to push snow simple by lowering the blade down into proximity with the ground and utilizing it in the same manner as a snowplow blade. If desired, this mode of operation may be used as a compliment to the above described towing mode. Also, with the blade 80 in the down position the present invention may be used to scrape road surfaces or the like by moving the apparatus forward in the direction of the hitch end.

As previously mentioned, side plates 90 and 92 may be connected to provide a measure against snow crumbling and spilling around blade 80 as quantities are moved. With the side plates attached, about six cubic yards accumulate before spillover occurs. Of course, the present invention may also be used to relocate quantities of other materials, for example dirt or manure, but in the case of dirt a heavier duty scraper blade 82 and cutting knives could be used.

If it is desired to transport the apparatus of the present invention, the suspensions 20 and 21 may be adjusted to the positions illustrated in FIG. 2. This may be accomplished by simply overextending the blade downwardly so as to raise the frame 10 off the ground to a position sufficiently high to allow the suspension armatures to be locked into the transport position, for example with bracket 25. The blade is then raised to its normal down position, and chained in place using chains 85, 86 and the respective hooks 87 and 88.

Thus, it will be seen that the present invention provides a new and useful method and apparatus for removing snow, which is especially advantageous for removing drifted or hard packed snow without the need to pulverize, compact or lift it. Accordingly, the present invention increases the capacity of known vehicles such as tractors and trucks to move snow relative to apparatus employing the old above-noted methods, with respect to overall power requirements.

The foregoing is merely descriptive of one embodiment of the present invention. It will be understood that other embodiments within the spirit and scope of the invention, as set forth in the claims herein appended, may be accomplished.

What is claimed is:

1. Snow removal apparatus comprising:

a rectangular frame and an adjustable wheeled suspension for supporting the frame in a raised transport position and a lowered snow removal position, said frame substantially open at one end and including a hitch at the other end for coupling to a prime mover;

a pair of vertical snow cutting knives mounted on opposite sides of the frame proximate the open end and extending downwardly from the frame in the lowered position to close proximity with the ground, each knife including a skid pad on the bottom end thereof;

whereby said vertical knives cut a quantity of snow loose from its position when the frame is moved along the ground; and a blade and subframe assembly for supporting the blade in a lowered position wherein the blade is disposed for moving snow cut by said knives and in a raised position wherein the blade is suspended above the upper ends of said vertical knives, said subframe assembly comprising a pair of beams pivotably connected to opposite sides of the frame and a pair of double acting hydraulic cylinders mounted between said frame and beams for moving said blade between said raised and lowered positions.

2. A snow removal apparatus according to claim 1 wherein said adjustable wheel suspension comprises a pair of armatures axially connected to a wheel on one end and pivotally mounted to said frame on the other end and downwardly extending brackets mounted on the frame on either side of the pivot mount for locking said armatures and said wheels in positions corresponding to said raised and lowered frame positions.

3. A snow removal apparatus according to claim 1 further comprising:

a horizontal snow cutting knife mounted between the bottom ends of said vertical knives proximate said skid pads.

* * * * *